US010888155B2

(12) United States Patent
Jimenez et al.

(10) Patent No.: US 10,888,155 B2
(45) **Date of Patent: *Jan. 12, 2021**

(54) ORAL CARE IMPLEMENT

(71) Applicant: Colgate-Palmolive Company, New York, NY (US)

(72) Inventors: Eduardo Jimenez, Manalapan, NJ (US); Joseph Fattori, East Sandwich, MA (US)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/822,572

(22) Filed: Nov. 27, 2017

(65) Prior Publication Data

US 2018/0078027 A1 Mar. 22, 2018

Related U.S. Application Data

(63) Continuation of application No. 15/101,920, filed as application No. PCT/US2014/064718 on Nov. 10, 2014, now Pat. No. 9,848,693, which is a continuation-in-part of application No. PCT/US2013/073412, filed on Dec. 5, 2013.

(51) Int. Cl.

| | |
|---|---|
| ***B43M 11/06*** | (2006.01) |
| ***A46B 11/00*** | (2006.01) |
| ***A46B 7/04*** | (2006.01) |
| ***A46B 15/00*** | (2006.01) |

(52) U.S. Cl.

CPC ..... *A46B 11/0062* (2013.01); *A46B 7/04* (2013.01); *A46B 11/0082* (2013.01); *A46B 11/0086* (2013.01); *A46B 15/0097* (2013.01); *A46B 2200/1066* (2013.01)

(58) Field of Classification Search

CPC ..... A46B 11/0082; A46B 11/0062; A46B 2200/1066

USPC ..... 401/198

See application file for complete search history.

(56) References Cited

U.S. PATENT DOCUMENTS

| | | | |
|---|---|---|---|
| 1,690,311 | A | 11/1928 | Reich |
| 1,899,242 | A | 2/1933 | McNab |
| 2,725,270 | A | 11/1955 | Upchurch |

(Continued)

FOREIGN PATENT DOCUMENTS

| | | |
|---|---|---|
| CN | 200947902 Y | 9/2007 |
| CN | 201384212 | 1/2010 |

(Continued)

OTHER PUBLICATIONS

US 5,724,971 A, 04/1998, Salinger (withdrawn)

(Continued)

*Primary Examiner* — Jennifer C Chiang

(57) ABSTRACT

An oral care implement and a method of forming the same. In one aspect, the invention can be an oral care implement having a handle and a head. The head has a basin cavity formed therein which has an open top end. An aperture is formed into the basin cavity that forms a passageway to an outer surface of the head. An applicator is positioned within the basin cavity so that a portion of the applicator protrudes through the aperture. The oral care implement also includes a head plate with a plurality of tooth cleaning elements mounted thereon. The head plate is coupled to the head and encloses the open top end of the basin cavity.

20 Claims, 7 Drawing Sheets

(56) References Cited

U.S. PATENT DOCUMENTS

| | | | |
|---|---|---|---|
| 3,325,847 | A | 6/1967 | Meranto |
| 4,583,563 | A | 4/1986 | Turner |
| 5,306,151 | A | 4/1994 | Rauch |
| 5,918,996 | A | 7/1999 | Coolbaugh |
| 6,318,685 | B1 | 11/2001 | Huber |
| 6,907,638 | B2 | 6/2005 | Katz |
| 7,917,986 | B2 | 4/2011 | Jimenez et al. |
| 8,016,129 | B2 | 9/2011 | Peterson |
| 8,079,109 | B2 | 12/2011 | Misner et al. |
| 8,141,563 | B2 | 3/2012 | De Masi, Sr. |
| 8,322,939 | B2 | 12/2012 | Xi, et al. |
| 8,398,326 | B2 | 3/2013 | Jimenez et al. |
| 8,506,196 | B2 | 8/2013 | Boyd et al. |
| 8,556,530 | B2 | 9/2013 | Kemp et al. |
| 9,033,602 | B2 | 5/2015 | Boyd et al. |
| 9,066,581 | B2 | 6/2015 | Hohlbein et al. |
| 9,603,444 | B2 | 3/2017 | Boyd et al. |
| 9,848,693 | B2 | 12/2017 | Jimenez et al. |
| 2002/0100134 | A1 | 8/2002 | Dunn et al. |
| 2006/0165473 | A1 | 7/2006 | Hohlbein |
| 2008/0148501 | A1 | 6/2008 | Falk |
| 2010/0050357 | A1 | 3/2010 | Misner et al. |
| 2010/0129144 | A1 | 5/2010 | Osborne |
| 2014/0000063 | A1 | 1/2014 | Lin |
| 2014/0119809 | A1 | 5/2014 | Worthington et al. |
| 2015/0265042 | A1 | 9/2015 | Worthington et al. |

FOREIGN PATENT DOCUMENTS

| | | |
|---|---|---|
| DE | 4438121 | 5/1996 |
| DE | 20102378 | 10/2001 |
| DE | 10028530 | 12/2001 |
| GB | 2 329 110 | 3/1999 |
| JP | 07-313251 | 12/1995 |
| KR | 20-0467690 | 6/2013 |
| WO | WO 94/27479 | 12/1994 |
| WO | WO 2001/26525 | 4/2001 |
| WO | 2006020700 | 2/2006 |
| WO | 2008/091933 | 7/2008 |
| WO | 2012134435 | 10/2012 |
| WO | WO2013130081 | 9/2013 |

OTHER PUBLICATIONS

International Search Report and the Written Opinion of the International Searching Authority issued in International Patent Application PCT/US2014/064718 dated Feb. 23, 2015.

ORAL CARE IMPLEMENT

CROSS-REFERENCE TO RELATED PATENT APPLICATIONS

The present patent application is a continuation of U.S. patent application Ser. No. 15/101,920, filed Jun. 5, 2016, which is a U.S. national stage application under 35 U.S.C. § 371 of PCT/US2014/064718, filed Nov. 10, 2014, which is a continuation-in-part of PCT/US2013/073412, filed Dec. 5, 2013, the entireties of which are incorporated herein by reference.

BACKGROUND OF THE INVENTION

Oral care implements that include dentifrice or other oral care materials in the handle so that the toothbrush and dentifrice can be carried as a single unit are known. Current devices of this type require a separate dispenser that can be removed from the handle for dispensing the dentifrice therefrom. Other devices of this type require some manual dispensing action by the user in order to dispense the dentifrice. Most known oral care implements that include dentifrice or other oral care materials therein require complicated manufacturing steps that render the commercialization of such oral care implements difficult to achieve in a cost-effective manner. Thus, a need exists for an oral care implement having liquid dispensing capabilities that is easy and cost-effective to manufacture and that results in automatic dispensing during use.

BRIEF SUMMARY OF THE INVENTION

Exemplary embodiments according to the present disclosure are directed to an oral care implement and a method of forming the same. The oral care implement may include a handle and a head. The head may have a basin cavity which has an open top end. An aperture may be formed into the basin cavity. An applicator may be positioned within the basin cavity so that a portion of the applicator protrudes through the aperture. The oral care implement may also include a head plate with a plurality of tooth cleaning elements mounted thereon. The head plate may be coupled to the head so as to enclose the open top end of the basin cavity.

In one aspect, the invention can be an oral care implement comprising: a handle; a head coupled to the handle, the head comprising a base portion comprising a basin cavity, the basin cavity comprising a basin floor and a basin sidewall and having an open top end; an aperture in at least one of the basin floor or the basin sidewall that defines a passageway from an outer surface of the head into the basin cavity; an applicator comprising an anchor portion and a delivery portion, the anchor portion disposed in the basin cavity and the delivery portion extending through the aperture so that a portion of the delivery portion is exposed on the outer surface of the head, the applicator formed of a first capillary material and loaded with an oral care material; and a cleaning element assembly comprising a head plate and a plurality of tooth cleaning elements mounted to the head plate, the cleaning element assembly coupled to the base portion of the head to enclose the open top end of the basin cavity.

In another aspect, the invention can be a method of forming an oral care implement comprising a head and a handle, the method comprising: a) forming a base portion of the head, the base portion comprising a basin cavity, the basin cavity comprising a basin floor and a basin sidewall and having an open top end, an aperture in at least one of the basin floor or the basin sidewall that defines a passageway from an outer surface of the head into the basin cavity; b) inserting an applicator into the basin cavity so that an anchor portion of the applicator is disposed within the basin cavity and a delivery portion of the applicator extending through the aperture so that a portion of the delivery portion is exposed on the outer surface of the head; c) forming a cleaning element assembly comprising a head plate and a plurality of tooth cleaning elements mounted to the head plate; and d) coupling the cleaning element assembly to the base portion of the head so that the cleaning element assembly encloses the open top end of the basin cavity.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
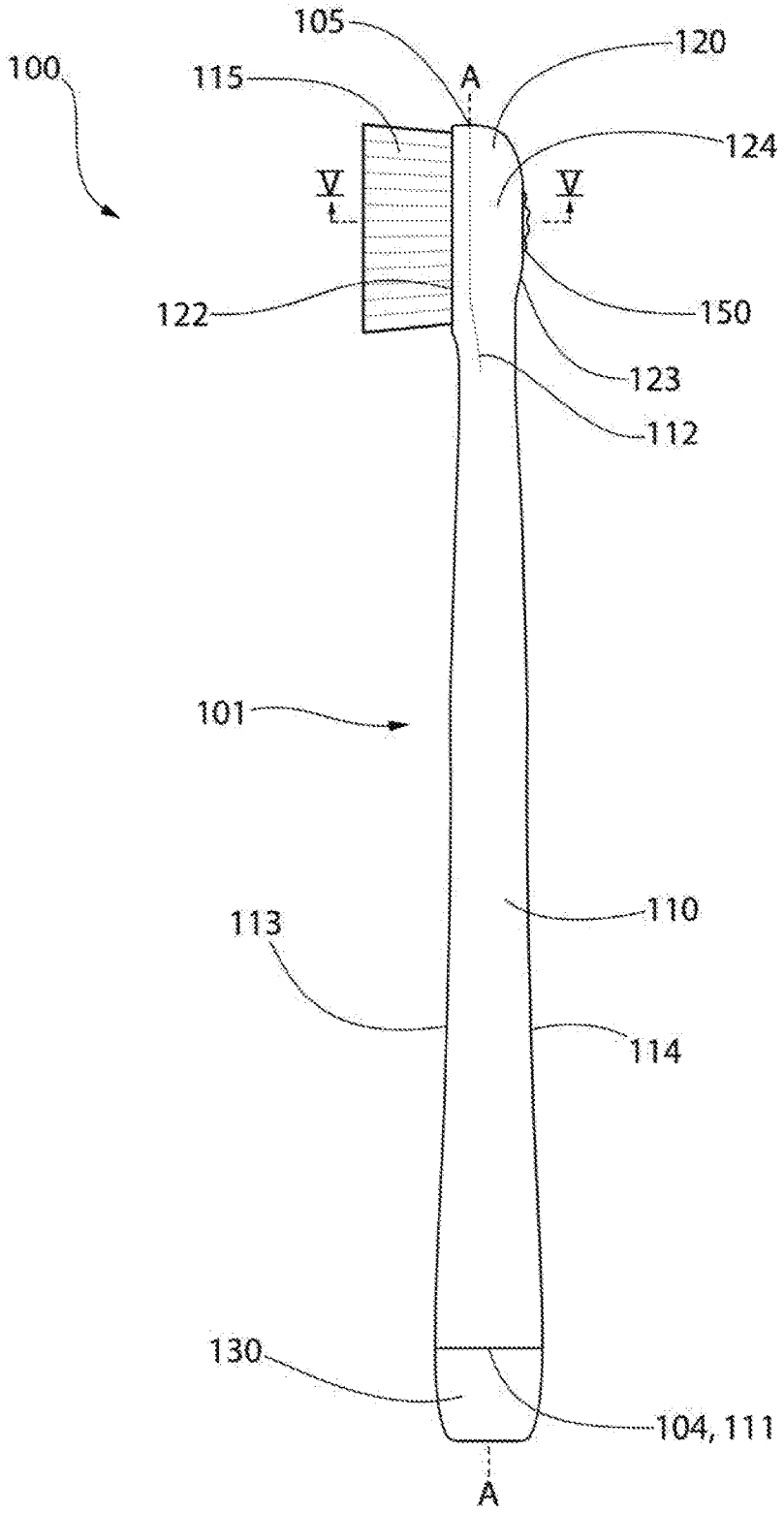
FIG. 1 is a side view of an oral care implement in accordance with a first embodiment of the present invention.
Figure 2:
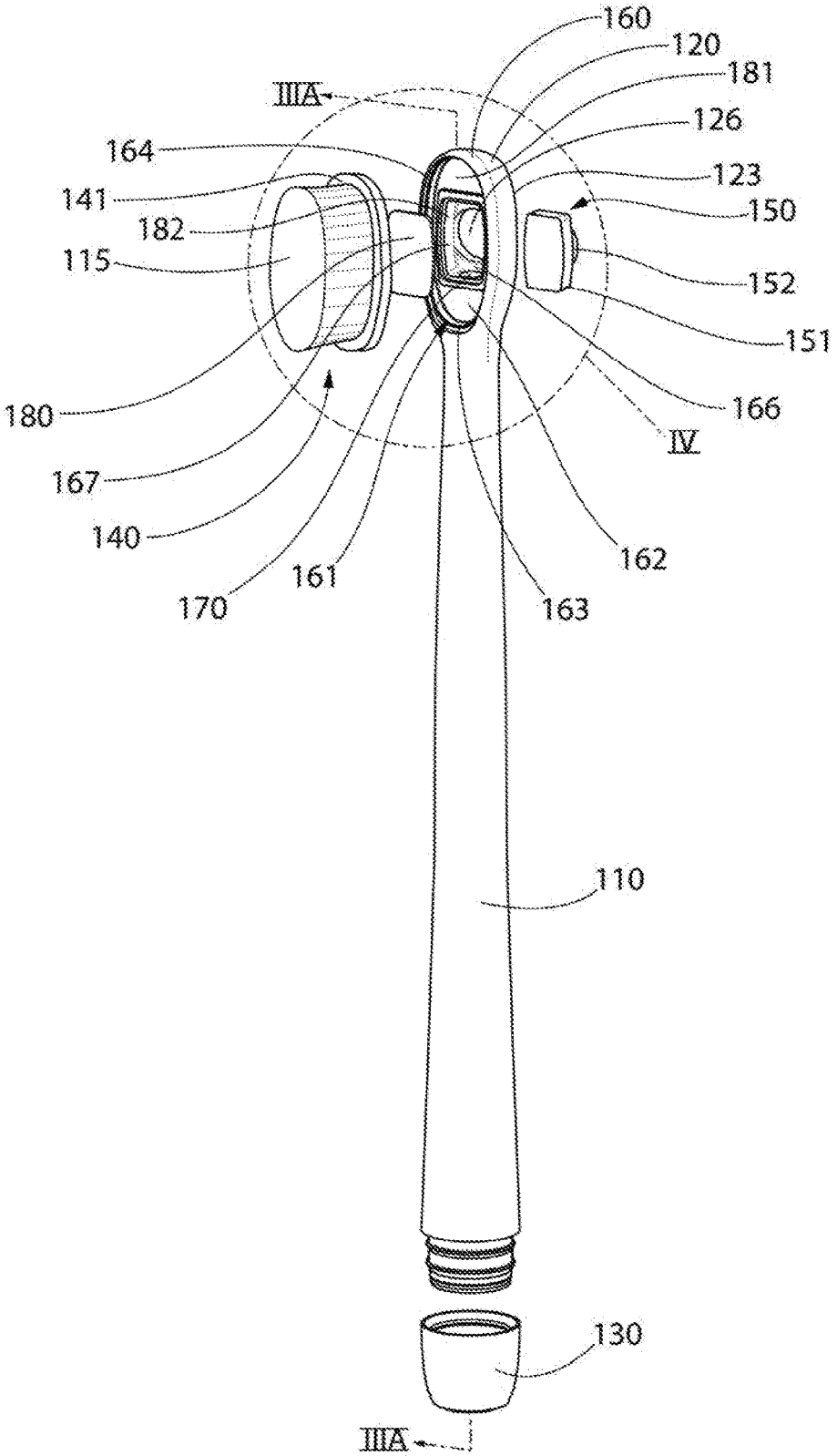
FIG. 2 is an exploded front perspective view of the oral care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100 generally includes a body 101 comprising a handle 110 and a head 120 and an end cap 130 that is detachably coupled to the handle 110. The body 101 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. The end cap 130 may be detachable from the handle 120 so that an oral care material can be stored within the body 101 (discussed in more detail below with reference to FIGS. 3A and 3B) and can be refilled by detaching the end cap 130 from the handle 110 to provide access to a cavity/reservoir within the body 101 within which the oral care material may be stored. Furthermore, in certain embodiments the end cap 130 may be altogether omitted and the proximal end 111 of the body 104 may form a closed bottom end of the oral care implement 100.

The handle 110 is an elongated structure that provides the mechanism by which the user can hold and manipulate the oral care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the oral care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, an applicator 150 is depicted protruding from the rear surface 123 of the head 120. In certain embodiments, the applicator 150 may protrude from the peripheral surface 124 of the head 120 instead of from the rear surface 123 of the head 120. The applicator 150 is intended to be loaded with an oral care material either during manufacturing or dynamically during use of the oral care implement 100, and the applicator 150 is intended to dispense the oral care material loaded thereon into a user's oral cavity during use of the oral care implement 100. The details of the structure and function of the applicator 150 will be described in more detail below with reference to FIGS. 2-5.

In the exemplified embodiment, the head 120 of the oral care implement 100 is provided with a plurality of tooth cleaning elements 115 extending from the front surface 122. Furthermore, in the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring briefly to FIGS. 2-5, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the oral care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the oral care implement 100. More specifically, the tooth cleaning elements 115 are secured to the head plate 141 in the manner discussed herein below to form the cleaning element assembly 140, and then the cleaning element assembly 140 is coupled to a base portion 160 of the head 120.

In certain embodiments, the head plate 141 comprises an upper surface 142 and an opposing lower surface 143. Furthermore, the head plate 141 comprises a plurality of tuft holes 144 extending through the head plate 141 from the upper surface 142 to the lower surface 143. The tooth cleaning elements 115 are grouped together into bristle tufts, each of which is positioned within one of the tuft holes 144 of the head plate 141. Specifically, the bristle tufts are positioned within the tuft holes 144 such that a first portion 116 of each of the bristle tufts extends from the upper surface 142 of the head plate 141 and a second portion 117 of each of the bristle tufts protrudes from the lower surface 143 of the head plate 141. Of course, elastomeric tooth cleaning elements may be positioned in one or more of the tuft holes 144 in place of bristle tufts in some embodiments.

The first portions 116 of the tooth cleaning elements 115 extending from the upper surface 142 of the head plate 141 perform the tooth cleaning function and the second portions 117 of the tooth cleaning elements 115 extending from the lower surface 143 of the head plate 141 are melted together by heat to be anchored in place. Specifically, melting the second portions 117 of the tooth cleaning elements 115 creates a melt matte 118 on the lower surface 143 of the head plate 141. The melt matte 118 is a layer of plastic formed from the collective second portions 117 of the tooth cleaning elements 115 that prevents the tooth cleaning elements 115 from being pulled through the tuft holes 141. More specifically, the melt matte 118 is a thin layer of plastic that is formed by melting the second portions 117 of the tooth cleaning elements 115 so that the second portions 117 of the tooth cleaning elements 115 transition into a liquid, at which point the liquid of the second portions 117 of the tooth cleaning elements 115 combine together into a layer of liquid plastic that at least partially covers the lower surface 143 of the head plate 141. This layer of liquid plastic then hardens when cooled to form the melt matte 118.

After the bristles are secured to the head plate 141, the head plate 141 is secured to the head 120 such as by ultrasonic welding. When the head plate 141 is coupled to the head 120, the melt matte 118 is located between the lower surface 143 of the head plate 141 and a basin floor of a basin cavity 161 of the head 120 in which the head plate 141 is disposed (discussed in more detail below). The melt matte 118, which is coupled directly to and in fact forms a part of the tooth cleaning elements 115, prevents the tooth cleaning elements 115 from being pulled through the tuft holes 141 in the head plate 141 thus ensuring that the tooth cleaning elements 115 remain attached to the head plate 141 during use of the oral care implement 100. This technique for mounting the tooth cleaning elements 115 to the head 120 via the head plate 141 is generally known as anchor free tufting (AFT).

In another embodiment, the tooth cleaning elements 115 may be connected to the head 120 using a technique known in the art as anchorless with round (AMR), which is a modified form of traditional AFT. In this technique, the handle is formed integrally with the head plate as a one-piece structure. After the handle and head plate are formed, the tooth cleaning elements are inserted into holes in the head plate so that free/cleaning ends of the tooth cleaning elements extend from the front surface of the head plate and bottom ends of the tooth cleaning elements are adjacent to the rear surface of the head plate. After the tooth cleaning elements are inserted into the holes in the head plate, the bottom ends of the tooth cleaning elements are melted together by applying heat thereto, thereby forming a melt matte at the rear surface of the head plate. After the heat is no longer applied, the melted bottom ends of the tooth cleaning elements solidify/harden to form the melt matte/thin layer of plastic. In some embodiments, after formation of the melt matte, a tissue cleaner is injection molded onto the rear surface of the head plate, thereby trapping the melt matte between the tissue cleaner and the rear surface of the head plate. In other embodiments, other structures may be coupled to the rear surface of the head plate to trap the melt matte between the rear surface of the head plate and such structure without the structure necessarily being a tissue cleaner. The structure can just be a plastic material that is used to form a smooth rear surface of the head, or the like, and the structure can be molded onto the rear surface of the head plate or snap-fit (or other mechanical coupling) to the rear surface of the head plate as desired.

Of course, techniques other than AFT and AMR can be used for mounting the tooth cleaning elements 115 to the head 120, such as widely known and used stapling techniques or the like. In such embodiments the head plate 141 may be omitted and the tooth cleaning elements 115 may be coupled directly to the head 120. Furthermore, in a modified version of the AFT process discussed above, the head plate 141 may be formed by positioning the tooth cleaning elements 115 within a mold, and then molding the head plate 141 around the tooth cleaning elements 115 via an injection molding process, which is known as in-mold tufting ("IMT).

Although not illustrated herein, in certain embodiments the head 120 may also include a soft tissue cleanser coupled to or positioned on its rear surface 123. Such a soft tissue cleanser may be positioned adjacent to the applicator 150 on the rear surface 123 of the head 120, and may surround the applicator 150. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 3A:
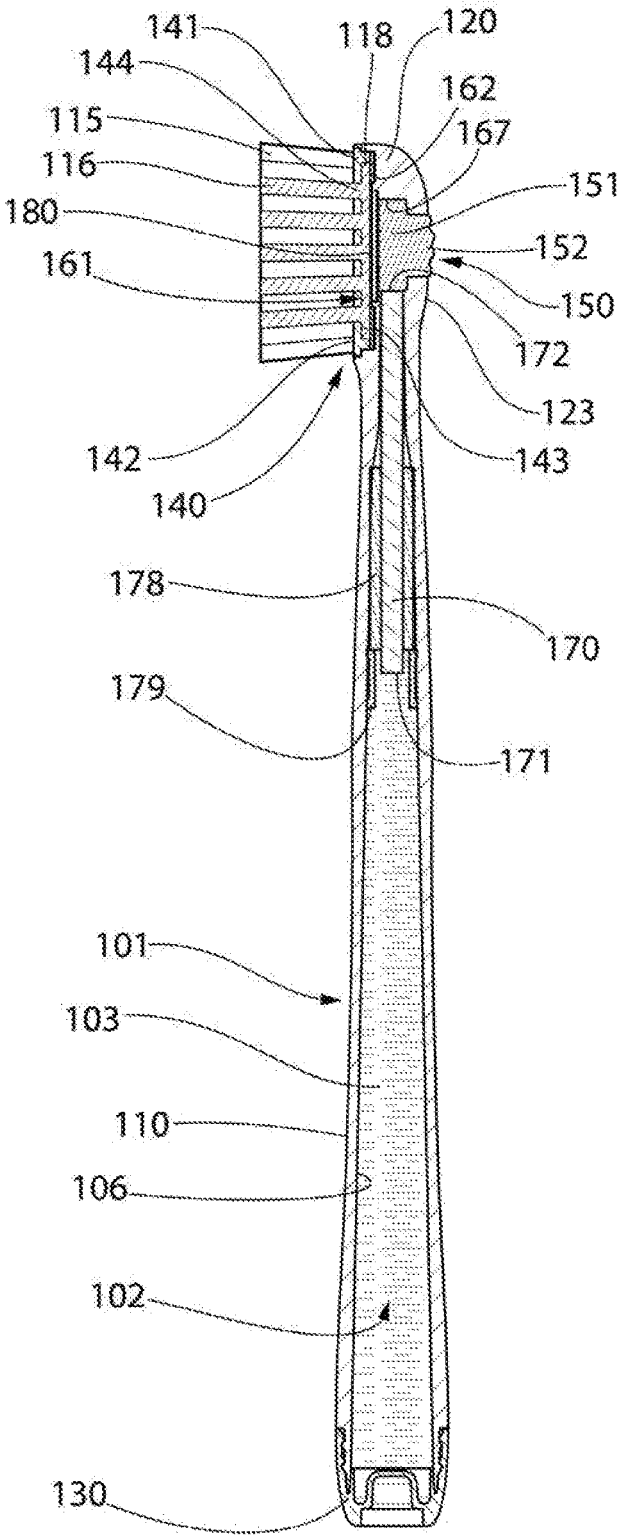
FIG. 3A is a cross-sectional view taken along line IIIA-IIIA of FIG. 2 in a fully assembled state.
Figure 3B:
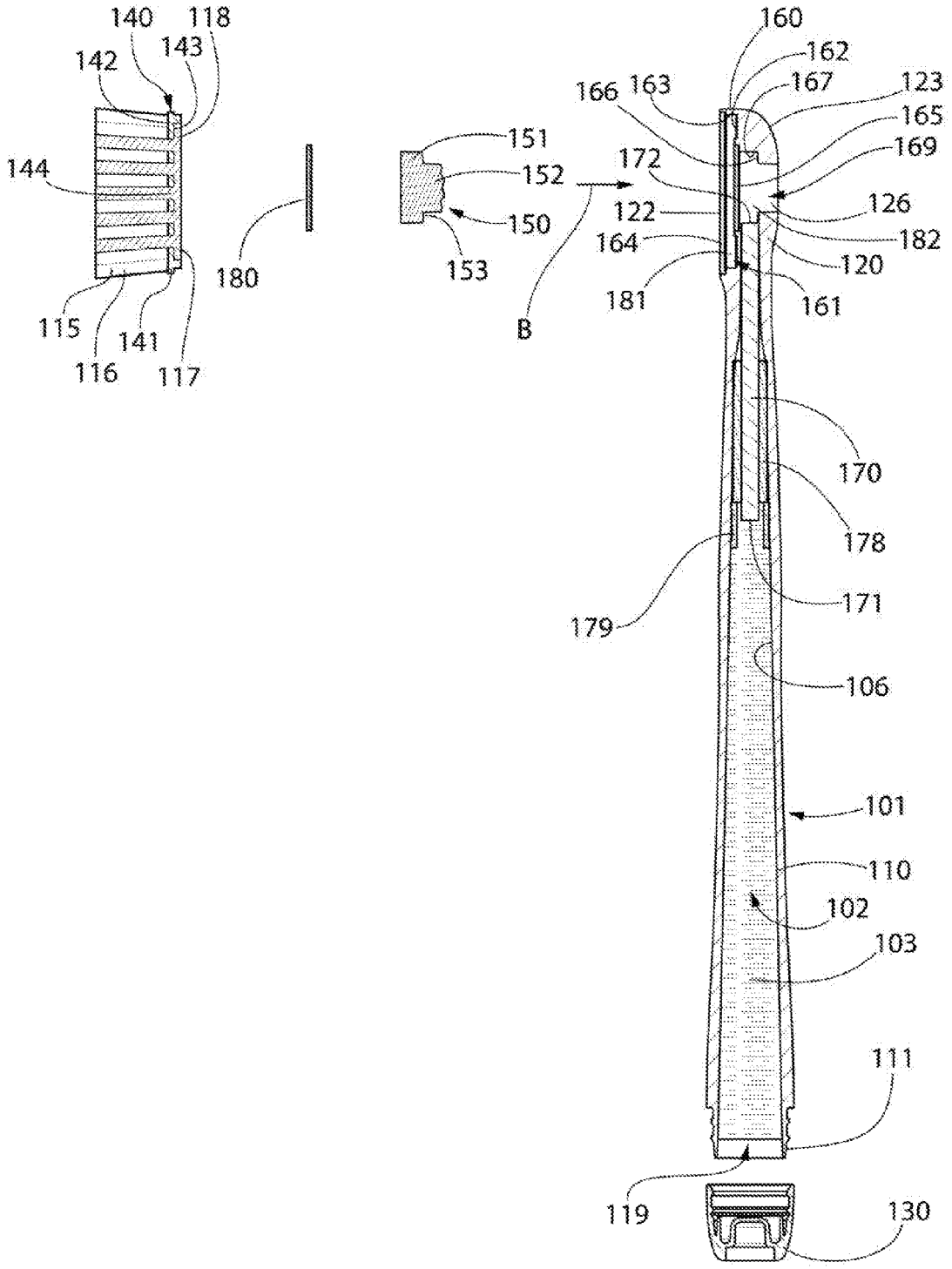
FIG. 3B is an exploded cross-sectional view taken along line IIIA-IIIA of FIG. 2.
Figure 4:
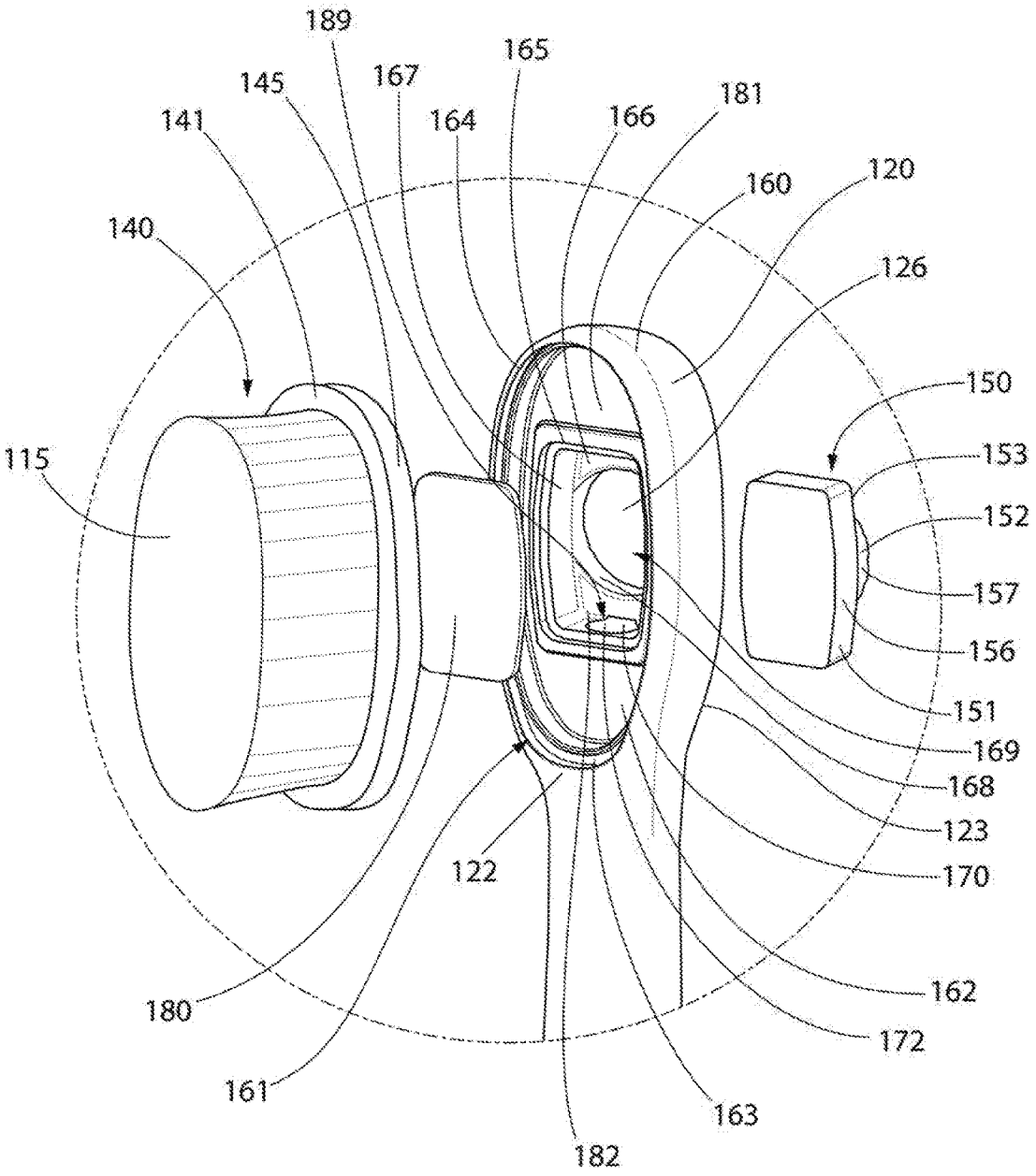
FIG. 4 is a close up of area IV of FIG. 2.

Referring now to FIGS. 3A and 3B concurrently, the oral care implement 100 will be further described. The body 101 of the oral care implement 100 has an inner surface 106 that defines an internal cavity or reservoir 102 that contains a store of oral care material 103. In the exemplified embodiment, the reservoir 102 is located entirely within the handle 110 of the body 101. However, the invention is not to be so limited in all embodiments and in certain other embodiments the reservoir 102 may be located partially or entirely within the head 120 of the body 101. In the exemplified embodiment, the head 120 of the oral care implement 100 comprises an aperture 126 that is in fluid communication with the store of oral care material 103 located within the reservoir 102. Specifically, a passageway is formed from the rear surface 123 of the head 120 through the aperture 126, from the aperture 126 into the basin cavity 161, and from the basin cavity 161 into the reservoir 102. Thus, the oral care material 102 stored within the reservoir 102 can flow from the reservoir 102 and out to a user's oral cavity through the aperture 126, as discussed in more detail below.

The oral care material 103 that is stored in the reservoir 102 can be any type of oral care material that is desired to be applied to a user's oral cavity. For example, in one embodiment the oral care material 103 may be a mouthwash. In another embodiment the oral care material 103 may be a dentifrice. In yet another embodiment, the oral care material 103 may be a tooth whitening agent, such as peroxide containing tooth whitening compositions. Other contemplated oral care materials that can be stored in the reservoir 102 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the oral care material can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

As noted above, the oral care implement 100 includes the end cap 130 that is coupled to the proximal end 111 of the handle 110. In the exemplified embodiment, the end cap 130 is coupled to the proximal end 111 of the handle 110 via a snap-fit connection. Of course, the invention is not to be so limited in all embodiments. In certain other embodiments, an interference fit, a threaded connection, a tight fit and other connection techniques can be used to detachably couple the end cap 130 to the handle 110. As illustrated in FIG. 3B, when the end cap 130 is separated from the handle 110, an opening 119 is exposed at the proximal end 111 of the handle 110 that provides access into the reservoir 102 within the handle 110. Thus, removing the end cap 130 from the handle 110 can enable a user to refill the reservoir 102 with the oral care material 103 or with a different oral care material as needed or desired. Of course, as noted above in other embodiments the end cap 130 may be omitted and in such embodiments upon depleting the oral care material 103 within the reservoir 102, the oral care implement 100 can be used as a conventional toothbrush without the benefits of the oral care material 103, the oral care implement 100 can be discarded, or the reservoir 102 can be refilled through the aperture 126. In certain embodiments, depletion of the oral care material 103 is achieved after a number of uses upon which it is generally desired to dispose of the oral care implement 100, such as for example without limitation after three months of use.

Referring to FIGS. 2-5 concurrently, the structure and components of the head 120 of the oral care implement 100 will be further described. The head 120 comprises a base portion 160 comprising a basin cavity 161. The basin cavity 161 comprises an upper chamber 181 and a lower chamber 182. Furthermore, the upper chamber 181 of the basin cavity 161 is defined by a floor 162 and a sidewall 163 and terminates in an open top end 164. An opening 165 is formed into the floor 162 of the upper chamber 181 and provides a passageway between the upper and lower chambers 181, 182. The lower chamber 182 of the basin cavity 161 is defined by a floor 166 and a sidewall 167. Furthermore, the aperture 126 is formed into the floor 166 of the lower chamber 182 and defines a passageway 169 from the rear outer surface 123 of the head 120 into the lower chamber 182 of the basin cavity 161. Thus, the basin cavity 161 forms a passageway through the entirety of the head from the rear surface 123, through the aperture 126, through the lower chamber 182, through the opening 165, through the upper chamber 181, and through the open top end 164 in the front surface 122 of the head 120.

When the tooth cleaning elements 115 are formed as a part of a cleaning element assembly 140, the cleaning element assembly 140 is coupled to the head 120 so that the melt matte 118 is located between the lower surface 143 of the head plate 141 and the floor 162 of the upper chamber 181. Furthermore, a peripheral edge 145 of the head plate 141 is positioned adjacent to the sidewall 163 of the upper chamber 181 of the basin cavity 161. In certain embodiments the peripheral edge 145 of the head plate 141 may be ultrasonically welded to the sidewall 163 of the upper chamber 181 of the basin cavity 161. In certain specific embodiments, the peripheral edge 145 of the head plate 141 may be ultrasonically welded to a shoulder 263 (FIG. 5) of the sidewall 163. Thus, in the assembled oral care implement the entirety of the cleaning element assembly 140 is positioned within the upper chamber 181 of the basin cavity 161 and encloses the open top end 164 of the basin cavity 161.

The floor 162 of the upper chamber 181 and the floor 166 of the lower chamber 182 may collectively form a basin floor and the sidewall 163 of the upper chamber 181 and the sidewall 167 of the lower chamber 182 may collectively form a basin sidewall. The aperture 126 is formed into at least one of the basin floor and the basin sidewall. In the exemplified embodiment, the aperture 126 is formed into the basin floor, and more specifically into the floor 166 of the lower chamber 182 of the basin cavity 161. The aperture 126 defines a passageway 169 from an outer surface of the head 120 into the basin cavity 161. More specifically, the aperture 126 is formed into the rear surface 123 of the head 120 and thereby defines a passageway 169 from the rear surface 123 of the head 120 into the lower chamber 182 of the basin cavity 161. The basin cavity 161 extends from the open top end 164 to the aperture 126, and thus the basin cavity 161, in combination with the aperture 126, forms a passageway entirely through the head 120 from the front surface 122 of the head 120 to the rear surface 123 of the head 120.

The sidewall 163 of the upper chamber 181 is a vertical surface that extends from the open top end 164 of the basin cavity 161 to the floor 162 of the upper chamber 181. The floor 162 of the upper chamber 181 is a horizontal surface that extends from the sidewall 163 of the upper chamber 181 to the sidewall 167 of the lower chamber 182. The sidewall 167 of the lower chamber 182 is a vertical surface that defines and surrounds a smaller area than the sidewall 163 of the upper chamber 181. Specifically, each of the sidewall 163 of the upper chamber 181 and the sidewall 167 of the lower chamber 182 is an annular wall that defines a closed-geometry and the space bounded by the sidewall 163 of the upper chamber 181 has a greater cross-sectional area than the space bounded by the sidewall 167 of the lower chamber 182. Stated another way, the upper chamber 181 has a greater cross-sectional area than the lower chamber 182. The sidewall 167 of the lower chamber 182 extends from the floor 162 of the upper chamber 181 to the floor 166 of the lower chamber. The floor 166 of the lower chamber 182 is a horizontal surface that extends from the sidewall 167 of the lower chamber 182 to a vertical wall 168 that defines the aperture 126 and the passageway 169.

Thus, the basin cavity 161 has multiple stepped surfaces such that the vertical wall 168 defines a smaller cross-sectional area than the sidewall 167 of the lower chamber 182, and the sidewall 167 defines a smaller cross-sectional area than the sidewall 163 of the upper chamber 181. Stated another way, the passageway 169 comprises a first cross-sectional area, the lower chamber 182 has a second cross-sectional area, and the upper chamber 181 has a third cross-sectional area, the second cross-sectional area being greater than the first cross-sectional area and the third cross-sectional area being greater than the second cross-sectional area. Thus, the cross-sectional area of the basin cavity 161 gets progressively larger in steps (not continuously) from the rear surface 123 of the head 120 to the front surface 122 of the head 120 (see FIGS. 3B and 5). This eases the manufacturing and assembly of the oral care implement 100, as discussed in more detail below.

The structure of the base portion 160 of the head 120 is designed to support the applicator 150 and the cleaning element assembly 140 within the basin cavity 161. Specifically, as noted above the cleaning element assembly 140 is positioned within the basin cavity 161 such that the lower surface 143 of the head plate 141 and the melt matte 118 are adjacent to the floor 162 of the upper chamber 182 of the basin cavity 161.

Furthermore, in the assembled oral care implement 100 the applicator 150 is also disposed within the basin cavity 161. The applicator 150 comprises an anchor portion 151 and a delivery portion 152. The anchor portion 151 forms a flange 153 that extends from the delivery portion 152. More specifically, the flange 153 of the anchor portion 151 is an annular flange that circumscribes the delivery portion 152. In the exemplified embodiment, the anchor portion 151 has a substantially rectangular shape and the delivery portion 152 has the shape of a dome or half-sphere that protrudes from one of the major surfaces of the anchor portion 151.

The anchor portion 151 of the applicator 150 is positioned within the lower chamber 182 of the basin cavity 161 and the delivery portion 152 of the applicator 150 extends through the aperture 126. More specifically, the anchor portion 151 of the applicator 150 is positioned within the lower chamber 182 of the basin cavity 161 such that an upper surface 155 of the anchor portion 151 rests against the floor 166 of the lower chamber 182 and a side surface 156 of the anchor portion 151 is positioned adjacent to (or abuts against) the sidewall 167 of the lower chamber 182. A first portion 159 of the delivery portion 152 is located within the passageway 169 and a second portion 158 of the delivery portion 152 protrudes through the aperture 126 and is exposed on the outer surface (and more specifically the rear surface 123) of the head 120. A periphery 157 of the delivery portion 150 is positioned adjacent to the vertical sidewall 168 defining the passageway 169, and the second portion 158 of the delivery portion 150 protrudes beyond the rear surface 123 of the head 120 and is exposed for direct contact with a user's oral surfaces during use of the oral care implement. In the exemplified embodiment, the second portion 158 of the delivery portion 150 comprises a ridged or ribbed surface so that the second portion 158 of the delivery portion 150 can be used to scrub debris from a user's oral surfaces.

The second portion 158 of the delivery portion 150 that protrudes beyond the rear surface 123 of the head 120 forms an island of the delivery portion 150 in that it is surrounded by the rear surface 123 of the head 120. Specifically, the second portion 158 of the delivery portion 150 is surrounded around its entire circumference by the material of the rear surface 123 of the head 120. In the exemplified embodiment, the second portion 158 of the delivery portion 150 is centrally located on the rear surface 123 of the head 120 such that it is equidistantly spaced from the proximal and distal ends of the head 120 and from the left and right lateral sides of the head 120. However, the invention is not to be so limited and the second portion 158 of the delivery portion 150 can be positioned at other locations on the rear surface 123 of the head 120 and still be completely surrounded by the rigid material of the head 120.

The anchor portion 151 of the applicator 150 rests upon the floor 166 of the lower chamber 181, which forms a shoulder of the base portion 160 that defines the aperture 126. Furthermore, the delivery portion 152 of the applicator 150 extends into and protrudes through the aperture 126 so as to be exposed through the aperture 126 on the rear surface 123 of the head 120. The anchor portion 152 of the applicator 150 has a cross-section that cannot pass through the aperture 126. Specifically, the size and shape of the anchor portion 152 of the applicator 150 is such that it cannot pass beyond the floor 166 of the lower chamber 182. Stated another way, the cross-sectional area (or the width or diameter) of the aperture 126 or passageway 169 (defined by the vertical sidewall 168) is smaller than the cross-sectional area (or the width or diameter) of the anchor portion 152 of the applicator 150, thereby preventing the anchor portion 152 of the applicator 150 from entering into the aperture 126 or the passageway 169. The delivery portion 152 of the applicator 150 has a smaller cross-sectional area than the anchor portion 152 of the applicator 150. More specifically, the cross-sectional area of the delivery portion 152 of the applicator 150 is less than or equal to the cross-sectional area of the aperture 126 and passageway 169 so that the delivery portion 152 of the applicator 150 can pass beyond the floor 166 of the lower chamber 182 and into and through the aperture 126 for exposure at the rear surface 123 of the head 120 to contact a user's oral surfaces during use of the oral care implement 100.

In the exemplified embodiment, the applicator 150 is formed of a first capillary material. The first capillary material can be any type of material through which a liquid can travel via capillary action or capillary flow. Specifically, the first capillary material can be a porous material, a fibrous material, a foam material, a sponge material, natural fibers, sintered porous materials, porous or fibrous polymers or other materials which conduct the capillary flow of liquids. Of course, the first capillary material is not to be limited by the specific materials noted herein, but can be any material that facilitates movement of a liquid therethrough via capillary action. Furthermore, although described herein as being formed of a capillary material, the invention is not to be so limited in all embodiments. In certain other embodiments the applicator 150 may be formed of a plastic material or a rubber material and may have an orifice formed therethrough to enable the oral care material to flow through the applicator 150 for application to a user's oral cavity.

In the exemplified embodiment, the applicator 150 is a relatively small structure such that it fits entirely within the head 120 of the oral care implement 100. Furthermore, as noted above in the exemplified embodiment the store of oral care material 103 is located within the reservoir 102 in the handle 110 of the oral care implement 100. Thus, the applicator 150 does not extend all the way into the reservoir 102, and no portion of the applicator 150 is in direct contact with the store of oral care material 103 within the reservoir 102. However, the applicator 150 is fluidly coupled to the store of oral care material 103 within the reservoir 102.

In the exemplified embodiment, fluid coupling between the applicator 150 and the store of oral care material 103 is achieved via a delivery member 170 formed of a second capillary material that is disposed within the oral care implement 100 and extends from the reservoir 102 to the applicator 150. Specifically, the delivery member 170 has a first end portion 171 that is in contact with (or positioned within) the store of oral care material 103 and a second end portion 172 that is in surface contact with the applicator 150, and more specifically with the anchor portion 151 of the applicator 150. More specifically, in the exemplified embodiment the second end portion 172 of the delivery member 170 is exposed through an opening 189 formed into the sidewall 167 of the lower chamber 182 of the basin cavity 161. Thus, when the applicator 150 is positioned within the lower chamber 182 of the basin cavity 161 as discussed herein above with the side surface 156 of the anchor portion 151 of the applicator 150 in contact with the sidewall 167 of the lower chamber 182 of the basin cavity 161, the side surface 156 of the anchor portion 151 of the applicator 150 is also in surface contact with the second end portion 172 of the delivery member 170. This enables fluid to flow from the delivery member 170 through the second end portion 172 and into the applicator 150.

In the exemplified embodiment, the first end portion 171 of the delivery member 170 terminates at a position only slightly within the reservoir 102. However, the invention is not to be so limited and the delivery member 170 may have a greater length so that the first end portion 171 of the delivery member 170 is positioned at a greater depth within the reservoir 102 closer to the proximal end 111 of the handle 110. Furthermore, in certain embodiments the delivery member 170 may be omitted and passive, mechanical, and/or electrical pump systems may be used to force the flow of the oral care material 103 from the reservoir 102 to the applicator 150 for application to a user's oral cavity.

Due to the delivery member 170 being formed of a second capillary material and being in direct contact with the oral care material in the store 103, the delivery member 170 transports the oral care material from the store 103 to the applicator 150. Specifically, the oral care material in the store 103 flows up the delivery member 170 from the first end 171 to the second end 172. The oral care material then flows from the second end 172 of the delivery member 170 and into the applicator 150, and more specifically into the anchor portion 151 of the applicator 150, due to the surface contact between the second end 172 of the delivery member 170 and the anchor portion 151 of the applicator 150. Finally, the oral care material flows from the anchor portion 151 of the applicator 150 into the delivery portion 152 of the applicator 150 and eventually to the second portion 158 of the delivery portion 152 of the applicator 150 that is exposed at the rear surface 123 of the head 120 for application/dispensing onto a user's oral surfaces. As a result, during use of the oral care implement 100 to brush a user's teeth with the tooth cleaning elements 115, the applicator 150 will contact a user's oral tissue surfaces and tongue and the oral care material 103 contained within the applicator 150 will be delivered onto the user's oral tissue surfaces and tongue due to such contact.

It should be appreciated that the delivery member 170 and the applicator 150 are separate components that are positioned into contact with one another in order to deliver the oral care material from the reservoir 102 to a user's oral cavity during use of the oral care implement 100. Forming the applicator 150 and the delivery member 170 as separate components simplifies manufacturing of the oral care implement 100, as discussed in more detail below.

As noted above, the delivery member 170 is formed of a second capillary material. The second capillary material can be any of the materials noted above with regard to the first capillary material of the applicator 150. The first and second capillary materials may be the same in some embodiments and different in other embodiments. During use of the oral care implement 100, the store of oral care material 103 is carried from the reservoir 102, through the delivery member 170, and to the applicator 150 where it can be dispensed into a user's oral cavity during toothbrushing or other oral hygiene activities. In certain embodiments, the first capillary material of the applicator 150 has a first capillarity and the second capillary material of the delivery member 170 has a second capillarity, the second capillarity being different than the first capillarity. In certain embodiments, the first capillarity may be a lower capillarity than the second capillarity.

The capillarity of the first and second capillary materials may refer to the flow rate of the oral care material through the delivery member 170 and the applicator 150, or it may refer to the volume of the oral care material that can be retained by the delivery member 170 and the applicator 150. Thus, in certain embodiments the second capillary material has smaller pores than the first capillary material, and thus the oral care material 103 may flow quicker through the second capillary material of the delivery member 170 than through the first capillary material of the applicator 150. In other embodiments, the second capillary material of the delivery member 170 may be capable of holding a greater volume of the oral care material 103 than the first capillary material of the applicator 150. Different permutations of the different capillary materials that are used to form the delivery member 170 and the applicator 150 are within the scope of the present invention to achieve a desired functional result.

The oral care implement 100 may also include a porous reservoir 178 and a retaining plug 179. The porous reservoir 178 is positioned within the reservoir 102 and surrounds the delivery member 170. The porous reservoir 178 may be formed of any of the capillary materials discussed above. Furthermore, the porous reservoir 178 serves as an overflow reservoir to temporarily hold a small volume of the oral care material to prevent the oral care material from spilling or oversaturating the delivery member 170 and/or applicator 150. The delivery member 170 is retained in position within the reservoir 102 via an interference fit with the inner surface 106 of the handle 110 and possibly also via contact with the retaining plug 179. Specifically, the retaining plug 179 is also positioned within the reservoir 102 and serves to retain the porous reservoir 178 in a specific position and to confine the free flow of liquid. The retaining plug 178 is impermeable to the free flow of liquid and may be formed of an elastomeric material. The retaining plug 178 may be sized and configured to snugly fit against the delivery member 170 in some embodiments to assist in proper positioning of the delivery member 170. The details of some embodiments of a retaining plug 178 are disclosed in US Patent Application Publication No. 2014/0119809, the entirety of which is incorporated herein by reference.

Figure 6:
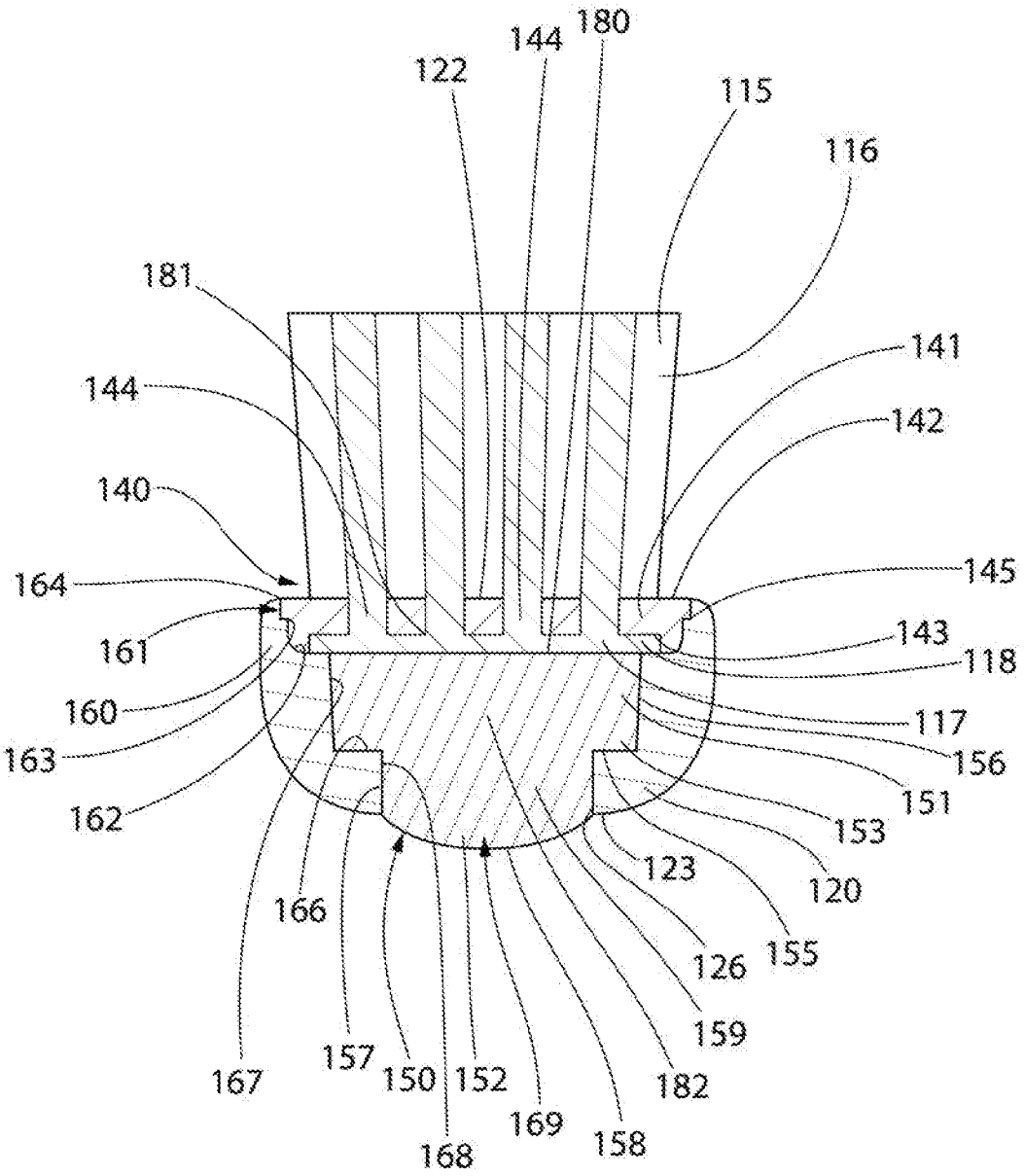
FIG. 6 is a transverse cross-sectional view of an oral care implement in accordance with a second embodiment of the present invention, wherein the divider member is omitted.

Furthermore, in the exemplified embodiment the oral care implement 100 comprises a divider member 180 that is positioned within the basin cavity 161. The divider member 180 may be located between the upper and lower chambers 181, 182 of the basin cavity 161. Specifically, the divider member 180 may be positioned atop of the floor 162 of the upper chamber 181 of the basin cavity 161 to close the opening 165 between the upper and lower chambers 181, 182. Thus, in the exemplified embodiment the space between the floor 162 of the upper chamber 181 and the open top end 164 of the basin cavity 161 forms the upper chamber 181 and the space between the floor 162 of the upper chamber 181 and the floor 166 of the lower chamber 182 forms the lower chamber 182. In certain embodiments, the lower chamber 182 may be considered to include the passageway 169, and thus, the lower chamber 182 may extend from the floor 162 of the upper chamber 181 to the rear surface 123 of the head 120. Of course, in certain embodiments the divider member 180 may be omitted, such as that which is shown in FIG. 6. In one such embodiment in which the divider member 180 is omitted, such as is shown in FIG. 6, the anchor portion 151 of the applicator 150 abuts and is in contact with the melt matte 118, thereby maintaining the melt matte 118 pressed against the lower surface 143 of the head plate 141. As a result, the tooth cleaning elements 115 are prevented from being pushed into the basin cavity upon use of the oral care implement.

In embodiments in which the divider member 180 is utilized, the divider member 180 provides a structure for dividing the basin cavity 161 into the upper and lower chambers 181, 182. The divider member 180 may also seal the upper end of the lower chamber 182, thereby preventing fluids from contacting the anchor portion 151 of the applicator 150 during use and preventing the oral care material in the applicator 150 from leaking into the upper chamber 181 and possibly from the front surface 122 of the head.

Regardless of whether or not the divider member 180 is positioned within the basin cavity 161 as noted herein, the anchor portion 151 of the applicator 150 is located in the lower chamber 182 and the head plate 141 of the cleaning element assembly 140 is located in the upper chamber 181. As noted herein, in the exemplified embodiment the anchor portion 151 of the applicator 150 is located entirely in the lower chamber 182 and the entirety of the head plate 141 is located in the upper chamber 181. It should be appreciated that the body portion 160 of the head 120, the head plate 141, the applicator 150, and the divider member 180 are separate components. Thus, the divider member 180 is formed separately from the body portion 160 of the head 120 and is not an integral part of the body portion 160 of the head 120. When used, the divider member 180 may be formed of any desired material, such as plastic, metal, or the like, and may be coupled to the head 120 in any manner desired including thermal or ultrasonic welding, adhesion, fasteners, or the like.

Referring to FIGS. 1-5 concurrently, a method of forming the oral care implement 100 will be described. To form the oral care implement 100, the handle 110 and the head 120 are first formed via an injection molding process. After the handle 110 and the head 120 are formed, the applicator 150 is inserted into the head 120. Specifically, the applicator 150 is inserted into the head 120 through the open top end 164 of the basin cavity 161 of the base portion 160 of the head 120 with the delivery portion 152 of the applicator 150 facing downwardly in the direction of movement of the applicator 150. Specifically, the applicator 150 is inserted into the head 120 in a direction perpendicular to the longitudinal axis A-A of the body 102 in the direction of the arrow B depicted in FIG. 3B.

As the applicator 150 is inserted through the open top end 164 of the basin cavity 161, the applicator 150 continues to be inserted into the basin cavity 161 so that it passes through the upper chamber 181, through the opening 165 in the floor 162 of the upper chamber 181, and into the lower chamber 182 of the basin cavity 161 until the anchor portion 151 of the applicator 150 comes to rest against the floor 166 of the lower chamber 182. When so positioned, the delivery portion 152 of the applicator 150 extends into and protrudes through the aperture 126. Specifically, the first portion 159 of the delivery portion 152 of the applicator 150 extends into the passageway 169 and the second portion 158 of the applicator 150 protrudes through the aperture 126 and beyond the rear surface 123 of the head 120 so as to be exposed on the rear surface 123 of the head 120.

In certain embodiments, after the applicator 150 is inserted into the basin cavity 161 the divider member 180 is inserted into the basin cavity 161 through the open top end 164 of the basin cavity 161. The divider member 180 is inserted into the basin cavity 161 until it comes to rest atop of the floor 162 of the upper chamber 181. Of course, as noted above the divider member 180 is not included in all embodiments and thus this step may be omitted.

At some point before, during, or after the formation of the handle 110 and the head 120, the cleaning element assembly 140 comprising the head plate 141 and the tooth cleaning elements 115 is formed as discussed above. Either after insertion of the divider member 180 or after insertion of the applicator 150 when the divider member 180 is omitted, the head plate 141 is inserted through the open top end 164 of the basin cavity 161. The head plate 141 is inserted until the melt matte 118 is trapped between the lower surface 143 of the head plate 141 and the floor 162 of the upper chamber 181 (or between the lower surface 143 of the head plate 141 and the divider member 180). After the head plate 141 is inserted into the basin cavity 161, the head plate 141 is secured to the base portion 160 of the head 120 via thermal fusion or some similar technique noted above.

Figure 5:
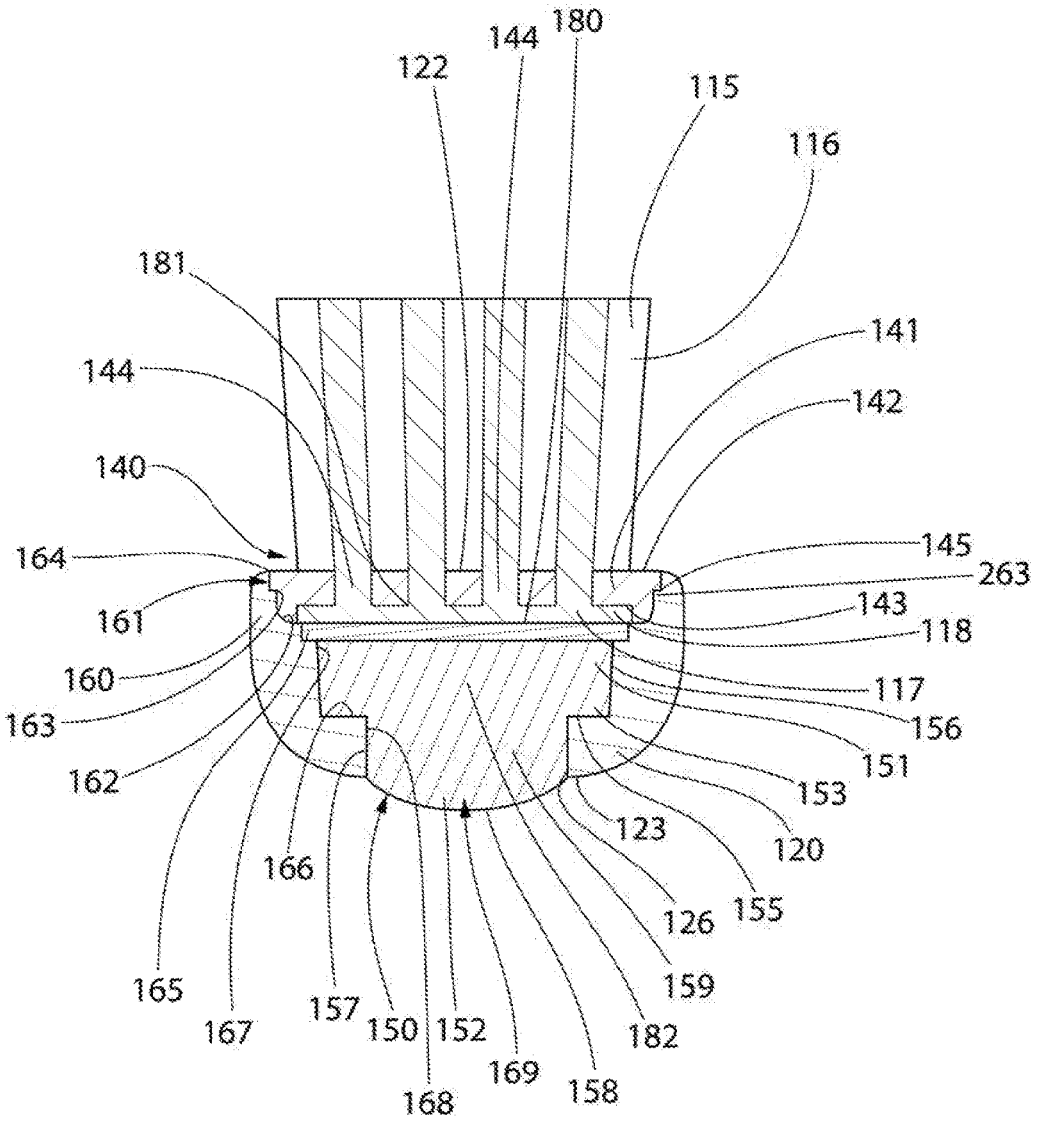
FIG. 5 is a transverse cross-sectional view taken along line V-V of FIG. 1.

Once the head plate 141 is secured to the base portion 160 of the head 120, the anchor portion 151 of the applicator 150 is trapped within the basin cavity 161 between the floor 166 of the lower chamber 182 and the lower surface 143 of the head plate 141. Specifically, because the anchor portion 151 of the applicator 150 has a larger cross-sectional area than the cross-sectional area of the aperture 126 and the passageway 169, the anchor portion 151 of the applicator 150 can not pass through the aperture 126 and passageway 169 and is retained in its place as depicted in FIGS. 3A and 5.

It should further be appreciated that when the delivery member 170 is used, it may be inserted into place and in contact with the reservoir 102 after the applicator 150 is inserted into the open top end 164 of the basin cavity 161. More specifically, the delivery member 170 is inserted so as to be in contact with and, thus in fluid coupling with, the applicator 150. As a result, the applicator 150 is fluidly coupled to the store of oral care material 103 in the reservoir 102. In one alternate embodiment, it may be possible to insert the delivery member 170 into the reservoir 102 before the applicator 150 is inserted into the open top end 164 of the basin cavity 161.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface, a rear surface opposite the front surface, and a base portion comprising a basin cavity having an open top end;

an aperture in the rear surface of the head that defines a passageway into the basin cavity;

an applicator disposed in the basin cavity and extending through the aperture, the applicator formed of a capillary material; and a cleaning element assembly comprising a head plate and a plurality of tooth cleaning elements mounted to the head plate, the cleaning element assembly coupled to the base portion of the head to enclose the open top end of the basin cavity.

2. The oral care implement according to claim 1 wherein the plurality of tooth cleaning elements comprises a plurality of bristle tufts; wherein the head plate comprises a lower surface, an upper surface, and a plurality of tuft holes extending from the lower surface to the upper surface; wherein each of the bristle tufts comprises a first portion and a second portion; wherein the second portions of the bristle tufts protrude from the lower surface of the head plate and are melted together to form a melt matte that is located between the lower surface of the head plate and the rear surface of the head.

3. The oral care implement according to claim 1 wherein a first portion of the applicator is located within the basin cavity and a second portion of the applicator protrudes from the rear surface of the head.

4. The oral care implement according to claim 3 wherein the first portion of the applicator is located between the cleaning element assembly and a floor of the basin cavity, the aperture extending through the floor of the basin cavity.

5. The oral care implement according to claim 3 wherein an entirety of the applicator is located within the basin cavity with the exception of the second portion of the applicator.

6. The oral care implement according to claim 1 wherein the base portion of the head is integrally formed with the handle.

7. The oral care implement according to claim 1 further comprising:

a store of oral care material in one of the head or the handle; and the applicator fluidly coupled to the store of oral care material so that the oral care material in the store is delivered to the applicator by capillary action.

8. The oral care implement according to claim 7 further comprising:

a delivery member extending from a first end to a second end, the first end of the delivery member in contact with the oral care material in the store and the second end of the delivery member in contact with the applicator, the delivery member transporting the oral care material from the store to the applicator;

the delivery member and the applicator being separate components; and wherein the store is located within the handle.

9. The oral care implement according to claim 8 wherein the second end of the delivery member is in surface contact with the applicator.

10. The oral care implement according to claim 1 further comprising a divider member dividing the basin cavity into an upper chamber and a lower chamber, the applicator being located in the lower chamber and the cleaning element assembly being located in the upper chamber.

11. The oral care implement according to claim 10 wherein the divider member has a front surface and a rear surface opposite the front surface, the front surface of the divider member being in surface contact with the cleaning element assembly and the rear surface of the divider member being in surface contact with the applicator.

12. The oral care implement according to claim 10 wherein the base portion of the head, the head plate, and the divider member are separate components.

13. The oral care implement according to claim 1 wherein the basin cavity extends from the open top end in the front surface of the head to the aperture in the rear surface of the head thereby forming a passageway entirely through the head from the front surface of the head to the rear surface of the head.

14. A method of forming an oral care implement comprising a head and a handle, the method comprising:

a) forming a base portion of the head, the base portion comprising a basin cavity having an open top end and an aperture that defines a passageway from an outer surface of the head into the basin cavity;

b) inserting an applicator into the basin cavity so that a portion of the applicator extends through the aperture and is exposed on the outer surface of the head;

c) forming a cleaning element assembly comprising a head plate and a plurality of tooth cleaning elements mounted to the head plate; and d) coupling the cleaning element assembly to the base portion of the head so that the cleaning element assembly encloses the open top end of the basin cavity.

15. The method according to claim 14 further comprising loading the applicator with an oral care material.

16. The method according to claim 14 further comprising, after step b) and prior to step c):

inserting a divider member into the basin cavity that divides the basin cavity into a lower chamber and an upper chamber, the applicator located in the lower chamber, wherein the divider member is in surface contact with the applicator within the basin cavity.

17. The method according to claim 16 wherein the applicator, the divider member, and the cleaning element assembly are inserted into the basin cavity through the open top end of the basin cavity in sequential order such that the applicator is inserted into the basin cavity first, the divider member is inserted into the basin cavity second, and the cleaning element assembly is inserted into the basin cavity third.

18. The method according to claim 14 wherein step c) comprises:

c-1) inserting a plurality of bristle tufts through a plurality of tuft holes in the head plate so that second portions of the plurality of bristle tufts extend from a lower surface of the head plate while first portions of the plurality of bristle tufts extend from an upper surface of the head plate; and c-2) fusing the second portions of the plurality of bristle tufts together to form a melt matte.

19. The method according to claim 14 further comprising providing a store of oral care material in the handle, the applicator fluidly coupled to the store of oral care material via a delivery member that extends from the store of oral care material to the applicator.

20. The method according to claim 14 wherein the aperture is formed into a floor of the basin cavity, and wherein a first portion of the applicator is located in the basin cavity and a second portion of the applicator protrudes from the outer surface of the head.

* * * * *